US011466333B2

(12) United States Patent
Zhang et al.

(10) Patent No.: US 11,466,333 B2
(45) Date of Patent: Oct. 11, 2022

(54) CONTINUOUS HOT ROLLED COIL FOR HIGH COLLAPSE-RESISTANT SEW PETROLEUM CASING AND MANUFACTURING METHOD THEREOF

(71) Applicant: Pangang Group Panzhihua Iron & Steel Research Institute Co., Ltd., Panzhihua (CN)

(72) Inventors: Kaihua Zhang, Panzhihua (CN); Xiaoyu Ye, Panzhihua (CN); Xuegang Xiong, Panzhihua (CN); Yi Wang, Panzhihua (CN)

(73) Assignee: Pangang Group Panzhihua Iron & Steel Research Institute Co., Ltd., Panzhihua (CN)

( * ) Notice: Subject to any disclaimer, the term of this patent is extended or adjusted under 35 U.S.C. 154(b) by 428 days.

(21) Appl. No.: 16/614,603

(22) PCT Filed: Jun. 20, 2018

(86) PCT No.: PCT/CN2018/091943

§ 371 (c)(1),
(2) Date: Nov. 18, 2019

(87) PCT Pub. No.: WO2019/047587

PCT Pub. Date: Mar. 14, 2019

(65) Prior Publication Data

US 2020/0399728 A1 Dec. 24, 2020

(30) Foreign Application Priority Data

Sep. 11, 2017 (CN) ..... 201710812899.0

(51) Int. Cl.

| | |
|---|---|
| ***C21D 9/00*** | (2006.01) |
| ***C22C 38/28*** | (2006.01) |
| ***C22C 38/04*** | (2006.01) |
| ***C22C 38/02*** | (2006.01) |
| ***C22C 38/00*** | (2006.01) |
| ***C21D 8/00*** | (2006.01) |
| ***C21D 6/00*** | (2006.01) |

(52) U.S. Cl.

CPC ..... *C21D 9/0068* (2013.01); *C21D 6/002* (2013.01); *C21D 6/005* (2013.01); *C21D 6/008* (2013.01); *C21D 8/005* (2013.01); *C22C 38/002* (2013.01); *C22C 38/02* (2013.01); *C22C 38/04* (2013.01); *C22C 38/28* (2013.01)

(58) Field of Classification Search

CPC ..... C21D 6/002; C21D 6/005; C21D 6/008; C21D 8/005; C21D 8/0205; C21D 8/0226; C21D 9/0068; C21D 9/08; C21D 9/46; C22C 38/002; C22C 38/02; C22C 38/04; C22C 38/08

See application file for complete search history.

(56) References Cited

U.S. PATENT DOCUMENTS 4,740,255 A 4/1988 Manton

FOREIGN PATENT DOCUMENTS

| | | | | |
|---|---|---|---|---|
| CN | 102212751 | A | | 10/2011 |
| CN | 102605235 | A | | 7/2012 |
| CN | 104561774 | A | | 4/2015 |
| CN | 106480375 | A | * | 3/2017 |
| CN | 106480375 | A | | 3/2017 |
| JP | 2001131698 | A | | 5/2001 |

OTHER PUBLICATIONS

English-language Abstract for CN 102212751 A (2011).
English-language Abstract for CN 102605235 A (2012).
English-language Abstract for CN 104561774 A (2015).
English-language Abstract for CN 106480375 A (2017).
English-language Abstract for JP 2001131698 A (2001).

* cited by examiner

*Primary Examiner* — Anthony M Liang
(74) *Attorney, Agent, or Firm* — Caesar Rivise, PC

(57) ABSTRACT

The invention discloses a continuous hot rolled coil for a high collapse-resistant SEW petroleum casing and a manufacturing method thereof, and belongs to the technical field of hot continuous rolling production. Provided is a continuous hot rolled coil for a high collapse-resistant SEW petroleum casing with low alloy element cost and excellent initial welding property, and a manufacturing method thereof. The production cost of the hot continuous rolled coil is lowered by reducing expensive alloy elements such as Mo and V therein, and strictly controlling the content components of chemical elements such as Cr, Mn and Ti. According to the manufacturing method, a continuous cast slab is used as an initial billet and subjected to rough rolling by refined grains for 5-7 passes under the temperature-controlled heating condition to form an intermediate billet, and then the intermediate billet is subjected to finish rolling for at least 4 passes, then finally cooled and coiled to complete the production and processing of the continuous hot rolled coils, and achieve the purpose of controlling the initial yield strength and the initial tensile strength.

12 Claims, 1 Drawing Sheet

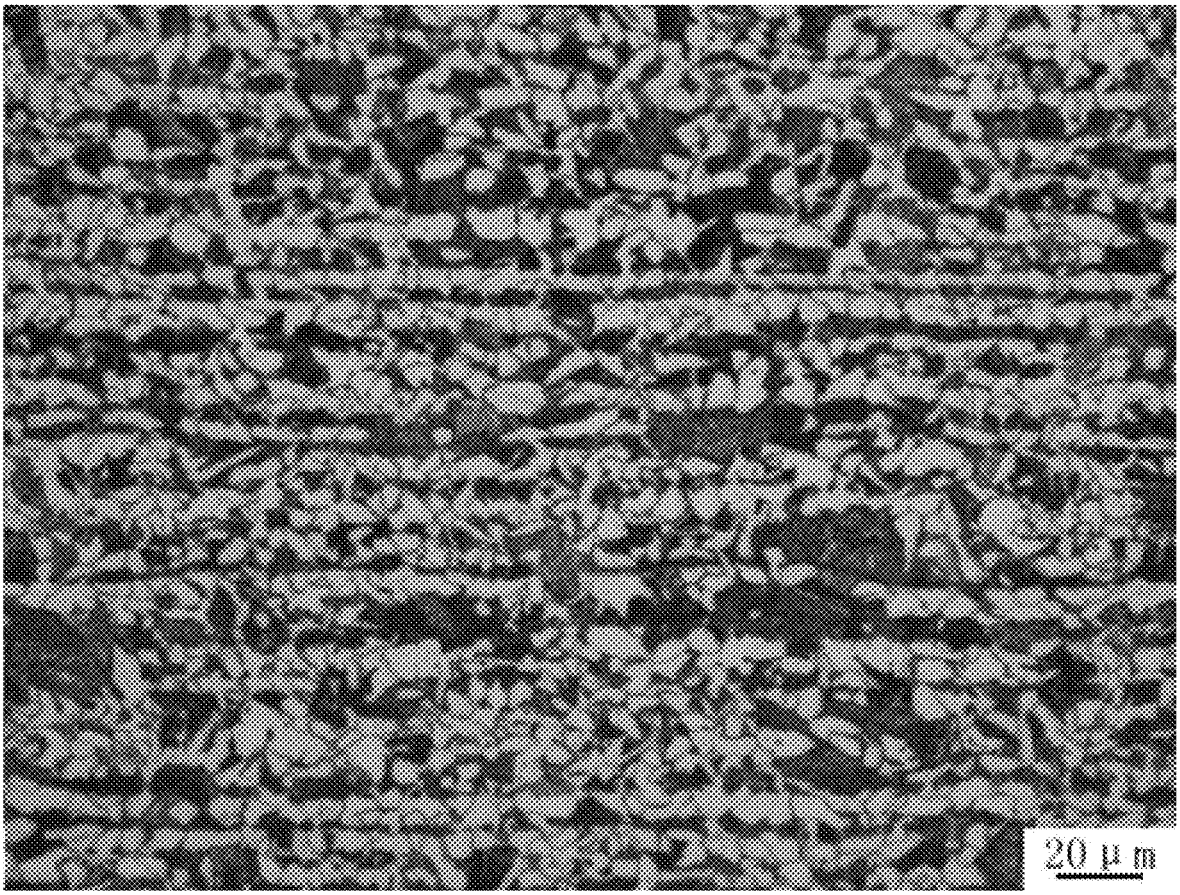
20 μm

CONTINUOUS HOT ROLLED COIL FOR HIGH COLLAPSE-RESISTANT SEW PETROLEUM CASING AND MANUFACTURING METHOD THEREOF

CROSS-REFERENCE TO RELATED APPLICATIONS

This application is a U.S. National Phase Application of PCT/CN2018/091943, filed Jun. 20, 2018, which claims priority to CN 201710812899.0, filed Sep. 11, 2017, the contents of which applications are incorporated herein by reference in their entireties for all purposes.

FIELD OF THE INVENTION

The invention relates to a continuous hot rolled coil, in particular to a continuous hot rolled coil for a high collapse-resistant SEW petroleum casing, and belongs to the technical field of continuous hot rolling production. The invention also relates to a manufacturing method of the continuous hot rolled coil thereof.

BACKGROUND OF THE INVENTION

The petroleum casing is not only an important pipeline material in the oil and natural gas exploitation process but also an essential construction material in drilling for oil and gas. Especially in recent years, deep and ultra-deep drilling leads to stringent requirements for the performance of petroleum casing; that is, the strength grade of high collapse-resistant SEW petroleum casing is getting higher and higher with the increasing demand. In the past, seamless pipes are mainly used as high collapse-resistant casings, which severely affecting the quality and benefit of oil drilling and exploitation due to many disadvantages like large wall thickness deviation, uneven performance, low collapse-resistance, perforation cracking and fast casing damage.

In recent years, a variety of high collapse-resistant SEW petroleum casings have been studied and produced. For example, the patent application document (patent number: 201110427453.9) discloses a high collapse-resistant SEW petroleum casing and a manufacturing method thereof, comprising the following chemical compositions: 0.25%-0.33% of C, 0.19%-0.28% of Si, 1.10%-1.30% of Mn, P (≤0.020%) and S (≤0.008%). However, the patent only relates to the manufacturing process of petroleum casings rather than the coils for petroleum casings; moreover, for the final steel pipes, the yield strength is 720-760 MPa and the tensile strength is more than 820 MPa, indicating a low yield strength. For another example, the patent application document (patent number: 200910018524.2) discloses a steel for N80, P110 and L80 SEW petroleum casings and a manufacturing method of the steel and the petroleum casings thereof, comprising the . following chemical compositions: 0.10%-0.28% of C, 0.12%-0.25% of Si, 1.10%-1.60% of Mn, 0.03-0.14% of P, 0.002-0.03% of S, 0.20%-0.70% of Cr, 0.07%-0.17% of Nb, 0.05%-0.15% of V, and 0.10-0.22% of Ti. In this patent, a great amount of expensive Nb and V are added and inevitably increase the alloy cost. Here is another example. The patent application document (patent number: 201310468738.6) discloses a P110 SEW petroleum casing and a manufacturing method thereof, comprising the following chemical compositions: 0.24%-0.28% of C, 0.15%-0.30% of Si, 1.25%-1.50% of Mn, P (≤0.020%), S (≤0.008%), 0.05%-0.08% of V and 0.010-0.30% of Ti. In this patent, as V is added, the strength of the petroleum casing is enhanced through V precipitation; however, the alloy cost is still relatively high. At the same time, the yield strength of the hot rolled coil of the invention is more than 570 MPa, making it difficult for subsequent pipe welding, which requires the yield strength of 780 MPa-850 MPa and the tensile strength of 880-970 MPa.

For this reason, it is a high priority to develop a high collapse-resistant SEW petroleum casing with excellent performance, which will be of far-reaching significance for saving the oil production cost and improving the oil production level. One of the most urgent problems to be solved by those skilled in the art is to produce continuous hot rolled coils for high collapse-resistant SEW petroleum casings by using a low-cost process route to reduce the strength of hot rolled coils and to facilitate subsequent pipe welding process and ensure the quenching and tempering treatment strength of welded pipes.

SUMMARY OF THE INVENTION

The technical problem to be solved by the invention is to provide a continuous hot rolled coil for a high collapse-resistant SEW petroleum casing with low alloy element cost and excellent initial welding property. Further, the invention provides a manufacturing method of the continuous hot rolled coil thereof.

A technical scheme for solving the technical problem of the invention is: a continuous hot rolled coil for a high collapse-resistant SEW petroleum casing, and the continuous hot rolled coil is a continuous cast and rolled coil comprising the following chemical components in parts by weight: 0.22-0.32% of C, 0.10-0.30% of Si, 1.10-1.40% of Mn, 0.30-0.60% of Cr, P (≤0.020%), S (≤0.010%), 0.008-0.019% of Ti, Fe and inevitable impurities.

For the continuous cast and rolled coil, the initial yield strength is 340-360 MPa and the initial tensile strength is 620-640 MPa. For the quenched and tempered continuous cast and rolled coil, the initial yield strength is 840 MPa-910 MPa and the initial tensile strength is 940-1030 MPa.

Further, the chemical compositions consist of 0.24-0.30% of C, 0.10-0.30% of Si, 1.20-1.40% of Mn, 0.40-0.50% of Cr, P (≤0.018%), S (≤0.005%), 0.010-0.017% of Ti, Fe and inevitable impurities.

In the manufacturing method of the continuous hot rolled coil, a continuous cast slab is used as an initial billet and subjected to rough rolling by refined grains for 5-7 passes under the temperature-controlled heating condition to form an intermediate billet, and the intermediate billet is subjected to finish rolling for at least 4 passes, then finally cooled and coiled to complete the production and processing; wherein the deformation of the billet must be not less than 18% in each pass where the billet is subjected to rough milling by refined grains, the intermediate billet subjected to rough rolling by refined grains is 3.8-4.2 times thicker than the finished continuous hot rolled coil, and the cooling method before coiling and after finish rolling is air cooling.

Further, the heating temperature is kept at 1180-1220° C. during each pass of rough rolling by refined grains. Preferably, the initial thickness of the continuous cast slab is 200-250 mm.

Further, each pass of finish rolling is completed at once by a finishing mill unit.

Further, the inlet temperature is kept at 970-1020° C. during finish rolling and the final rolling temperature is 850-900° C.

Further, the slab subjected to rough rolling by refined grains is fed into a hot coil box for coiling the head and tail thereof alternately, and then is uncoiled for temperature control and finish rolling in a finish rolling area.

The beneficial effects of the invention are as follows: the application realizes the reduction of expensive alloy elements like Mo and V, and the strict control of the content of expensive chemical elements like Cr, Ti and Si and the rolling production process; namely, a continuous cast slab is used as an initial billet and is subjected to rough rolling by refined grains for 5-7 passes under the temperature-controlled heating condition to form an intermediate billet, and the intermediate billet is subjected to finish rolling for at least 4 passes, then finally cooled and coiled to complete the production and processing of the continuous hot rolled coil. Especially, the deformation of the billet must be not less than 18% in each pass where the billet is subjected to rough milling by refined grains, the intermediate billet subjected to rough rolling by refined grains is 3.8-4.2 times thicker than the finished continuous hot rolled coil, and the cooling method before coiling and after finish rolling is air cooling. In this way, the purpose of reducing the production cost is achieved, and the mechanical properties of the material can be ensured due to the existence of Cr which can improve the strength of the material and its collapse resistance. Then, supplemented by the rolling parameters of the process steps thereof, the purpose of improving the welding and mechanical property of the continuous hot rolled coil provided by the application can be achieved. Namely, for the continuous hot rolled coil, the initial yield strength is 340-360 MPa and the initial tensile strength is 620-640 MPa, which ensures both the excellent welding property of the continuous hot rolled coil and the finished product. For the quenched and tempered continuous hot rolled coil, the initial yield strength is 840 MPa-910 MPa and the initial tensile strength is 940-1030 MPa.

BRIEF DESCRIPTION OF THE DRAWINGS

FIG. 1 is a metallographic structure of some banded structures formed by air cooling of a continuous hot rolled coil for a high collapse-resistant SEW petroleum casing of the invention.

DETAILED DESCRIPTION OF THE PREFERRED EMBODIMENT

In order to solve the technical problem in the prior art, the invention provides a continuous hot rolled coil for a high collapse-resistant SEW petroleum casing with low alloy element cost and excellent initial welding property. Further, the invention provides a manufacturing method of the continuous hot rolled coil thereof. The continuous hot rolled coil consists of the following chemical components in parts by weight: 0.22-0.32% of C, 0.10-0.30% of Si, 1.10-1.40% of Mn, 0.30-0.60% of Cr, P (≤0.020%), S (≤0.010%), 0.008-0.019% of Ti, Fe and inevitable impurities. For the continuous cast and rolled coil, the initial yield strength is 340-360 MPa and the initial tensile strength is 620-640 MPa. For the quenched and tempered continuous cast and rolled coil, the initial yield strength is 840 MPa-910 MPa and the initial tensile strength is 940-1030 MPa. Further, a continuous cast slab is used as an initial billet and subjected to rough rolling by refined grains for 5-7 passes under the temperature-controlled heating condition to form an intermediate billet, and the intermediate billet is subjected to finish rolling for at least 4 passes, then finally cooled and coiled to complete the production and processing of the continuous hot rolled coils; wherein the deformation of the billet must be not less than 18% in each pass where the billet is subjected to rough milling by refined grains, the intermediate billet subjected to rough rolling by refined grains is 3.8-4.2 times thicker than the finished continuous hot rolled coil, and the cooling method before coiling and after finish rolling is air cooling. The application can realize the reduction of expensive alloy elements like V and Mo, and the strict control of the content of expensive alloy elements like Cr, Ti and Si and the rolling production process; namely, a continuous cast slab is used as an initial billet and subjected to rough rolling by refined grains for 5-7 passes under the temperature-controlled heating condition to form an intermediate billet, and then the intermediate billet is subjected to finish rolling for at least 4 passes, then finally cooled and coiled to complete the production and processing of the continuous hot rolled coil. Especially, the deformation of the billet must be not less than 18% in each pass where the billet is subjected to rough milling by refined grains, the intermediate billet subjected to rough rolling by refined grains is 3.8-4.2 times thicker than the finished continuous hot rolled coil, and the cooling method before coiling and after finish rolling is air cooling. In this way, the purpose of reducing the production cost is achieved, and the mechanical properties of the material can be ensured due to the existence of Cr which can improve the strength of the material and its collapse resistance. Then, supplemented by the rolling parameters of the process steps thereof, the purpose of improving the welding and mechanical property of the continuous hot rolled coil provided by the application can be achieved, excellent welding property of the continuous hot rolled coil and the finished product can be ensured. Namely, for the continuous hot rolled coil, the initial yield strength is 340-360 MPa and the initial tensile strength is 620-640 MPa, which ensures both the excellent welding property of the continuous hot rolled coil and the finished product. For the quenched and tempered continuous hot rolled coil, the initial yield strength is 840 MPa-910 MPa and the initial tensile strength is 940-1030 MPa. FIG. 1 is a metallographic structure of some banded structures formed by air cooling of a continuous hot rolled coil for a high collapse-resistant SEW petroleum casing of the invention, with the aim of controlling the strength of the continuous hot rolled coil before subsequent heat treatment.

In the above embodiments, in order to maximize the welding and mechanical property of the continuous hot rolled coil described in this application, the application provides a continuous hot rolled coil with more stringent chemical compositions, i.e. the chemical compositions consist of 0.24-0.30% of C, 0.10-0.30% of Si, 1.20-1.40% of Mn, 0.40-0.50% of Cr, P (≤0.018%), S (≤0.005%), 0.010-0.017% of Ti, Fe and inevitable impurities. Further, the invention adjusts the corresponding procedures in the rolling production process; that is, the heating temperature is kept at 1180-1220° C. during each pass of rough rolling by refined grains, the initial thickness of the continuous cast slab is 200-250 mm, each pass of finish rolling is completed at once by a finishing mill unit, the inlet temperature is kept at 970-1020° C. during finish rolling and the final rolling temperature is 850-900° C., and the slab subjected to rough rolling by refined grains is fed into a hot coil box for coiling the head and tail thereof alternately, then is uncoiled for temperature control and finish rolling in a finish rolling area. The application adjusts and improves the performance of the finished steel plate by controlling the compositions and making full use of trace alloy elements; namely, making full use of the alloy elements such as C, Si, Mn, Cr and Mo rather than adjusting the performance of the finished steel plate by controlling the impurity content, wherein the role of various trace alloy elements in the finished steel plate is as follows:

C is a carbide former capable of improving the strength. However, high C content is easy to form banded structure. This patent makes the best matching in controlled rolling and cooling process, effectively inhibiting the formation of banded structure.

Si is a solid soluble in ferrite, and can improve the yield strength of steel. High Si content will deteriorate the processing and toughness, and the scale on the surface is "red rust", which is not easy to descale.

Mn is an austenite former, which can improve the hardenability of steel, and play a solid solution strengthening role in steel. In addition, Mn can improve the strength of steel, easily form structure segregation in case of too high Mn content, and affect the impact and drop hammer performance.

Cr is an element that strongly improves hardenability and is a strong precipitate former. During subsequent heat treatment, the heat treatment process window can be expanded to form precipitates, thus obviously improving the strength of steel products.

Mo is able to improve the stability of austenite and the subsequent heat treatment control process (enlarge heat treatment process window). The strength of steel is improved through precipitation with V and Ti. Moreover, Mo has obvious refining effect on precipitated phase, which can inhibit the maturation and growth of precipitated phase and keep the proportion of precipitated phase below 10 nm at above 70%.

Example

The production technical process of the invention is as follows: molten iron desulphurization→converter smelting and combined blowing→deoxidization and alloying→LF electric heating→RH vacuum treatment→calcium-wire feeding→continuous casting→slab heating→high pressure water descaling→rough milling→coiling by hot coil box→finish rolling→laminar cooling→coiling→packaging and warehousing.

The continuous hot rolled coil for high collapse-resistant SEW petroleum casing is smelted in a conventional converter and is continuously casted to obtain finished steel, with the chemical compositions comprising 0.22-0.32% of C, 0.10-0.30% of Si, 1.10-1.40% of Mn, 0.30-0.60% of Cr, P (≤0.020%), S (≤0.010%), 0.008-0.019% of Ti, Fe and inevitable impurities.

The slab obtained from continuous casting is heated to 1180-1220° C. for heat preservation and rough rolling. Depending on the thickness of finished product, the slab with a thickness of 200-250 mm is subjected to rough rolling for 5 or 7 passes, with the deformation not less than 18%. The thickness of the intermediate billet varies according to the finished product, but the intermediate billet must be more than four times thicker than the finished product.

The billet subjected to rough rolling is then coiled in a hot coil box, which can be, for example, a coreless transfer hot coil box. The head-to-tail exchange of the intermediate billet is realized in the hot coil box to ensure the uniform temperature of the whole billet length, and remove the secondary oxide scale to ensure a smooth slab surface.

The intermediate billet is shifted and uncoiled after being coiled by a hot coil box, entered a finish rolling area for finish rolling with the finish rolling entry temperature of 970-1020° C. and the final rolling temperature of 850-900° C.; and air cooling is adopted after finish rolling.

The following are five embodiments of the invention. Table 1 shows the chemical compositions of the five embodiments of the invention, Table 2 shows the control values of the hot rolling process, and Table 3 shows the mechanical properties of coils.

TABLE 1

Chemical compositions in example

| Example | C | Si | Mn | Cr | P | S | Ti |
|---|---|---|---|---|---|---|---|
| 1 | 0.29 | 0.2 | 1.30 | 0.43 | 0.012 | 0.002 | 0.016 |
| 2 | 0.27 | 0.19 | 1.27 | 0.44 | 0.012 | 0.003 | 0.016 |
| 3 | 0.29 | 0.22 | 1.31 | 0.45 | 0.013 | 0.002 | 0.014 |
| 4 | 0.28 | 0.22 | 1.32 | 0.46 | 0.011 | 0.002 | 0.013 |
| 5 | 0.28 | 0.21 | 1.34 | 0.44 | 0.012 | 0.002 | 0.014 |

TABLE 2

Control value of hot rolling process in examples

| Examples | Tapping temperature/ ° C. | Thickness of intermediate billet/mm | Initial rolling temperature/ ° C. | Finish rolling temperature/ ° C. |
|---|---|---|---|---|
| 1 | 1212 | 44 | 1005 | 882 |
| 2 | 1208 | 44 | 1002 | 885 |
| 3 | 1210 | 44 | 997 | 865 |
| 4 | 1205 | 44 | 992 | 872 |
| 5 | 1210 | 44 | 1000 | 883 |

TABLE 3

Mechanical properties of steel coil in examples

| Examples | Yield strength (ReL) MPa | Tensile strength (Rm) MPa | Elongation (A) % | Cold bend B = 35, α = 180°, d = a |
|---|---|---|---|---|
| 1 | 345 | 637 | 37.0 | Acceptable |
| 2 | 344 | 623 | 37.5 | Acceptable |
| 3 | 348 | 634 | 38.5 | Acceptable |
| 4 | 351 | 636 | 36.0 | Acceptable |
| 5 | 363 | 639 | 37.0 | Acceptable |

The invention claimed is:

1. A method of manufacturing a continuous hot rolled coil for a Stretch-reducing Electric Welding (SEW) petroleum casing, said method comprising:

providing a continuous cast slab for use as an initial billet;

subjecting the initial billet to rolling for 5-7 passes under a temperature-controlled heating condition to form an intermediate billet comprising refined grains therein;

subjecting the intermediate billet to finish rolling for at least 4 passes, and cooling and coiling the intermediate billet after the finish rolling to provide the continuous hot rolled coil, wherein:

a deformation of the initial billet must be not less than 18% in each pass where the initial billet is subjected to the rolling to form the refined grains;

the intermediate billet subjected to the finish rolling is 3.8-4.2 times thicker than the continuous hot rolled coil;

the cooling of the intermediate billet before coiling is air cooling;

the continuous hot rolled coil comprises the following chemical components in parts by weight: 0.22-0.32% of C, 0.10-0.30% of Si, 1.10-1.40% of Mn, 0.30-0.60% of Cr, ≤0.020% of P, ≤0.010% of S, 0.008-0.019% of Ti, Fe and inevitable impurities;

an initial yield strength of the continuous hot rolled coil is 340-360 MPa;

an initial tensile strength of the continuous hot rolled coil is 620-640 MPa;

a yield strength of the continuous hot rolled coil after quenching and tempering is 840 MPa-910 MPa; and a tensile strength of the continuous hot rolled coil after quenching and tempering is 940-1030 MPa.

2. The method according to claim 1, wherein a heating temperature is kept at 1180-1220° C. during each pass of the rolling.

3. The method according to claim 1, wherein an initial thickness of the continuous cast slab is 200-250 mm.

4. The method according to claim 1, wherein each pass of the finish rolling is completed at once by a finishing mill unit.

5. The method according to claim 4, wherein an inlet temperature is kept at 970-1020° C. during the finish rolling and a finish rolling temperature is 850-900° C.

6. The method according to claim 1, wherein the initial billet subjected to the rolling enters a hot coil box for coiling a head and a tail thereof alternately, and then is uncoiled for temperature control and finish rolling in a finish rolling area.

7. The method according to claim 1, wherein the chemical components are 0.24-0.30% of C, 0.10-0.30% of Si, 1.20-1.40% of Mn, 0.40-0.50% of Cr, ≤0.018% of P, ≤0.005% of S, 0.010-0.017% of Ti, Fe and inevitable impurities.

8. The method according to claim 7, wherein a heating temperature is kept at 1180-1220° C. during each pass of the rolling.

9. The method according to claim 7, wherein an initial thickness of the continuous cast slab is 200-250 mm.

10. The method according to claim 7, wherein each pass of the finish rolling is completed at once by a finishing mill unit.

11. The method according to claim 10, wherein an inlet temperature is kept at 970-1020° C. during the finish rolling and a finish rolling temperature is 850-900° C.

12. The method according to claim 7, wherein the initial billet subjected to the rolling enters a hot coil box for coiling a head and a tail thereof alternately, and then is uncoiled for temperature control and finish rolling in a finish rolling area.

* * * * *